US005751251A

United States Patent [19]

Hutchinson

[11] Patent Number: 5,751,251

[45] Date of Patent: May 12, 1998

[54] AUTOMOTIVE MOBILE TELEPHONE ANTENNA SILENCER

[76] Inventor: Ronald M. Hutchinson, 1330 Lexington Ct., Brookfield, Wis. 53045

[21] Appl. No.: 619,849

[22] Filed: Mar. 20, 1996

[51] Int. Cl.[6] ..... H01Q 1/32

[52] U.S. Cl. ..... 343/715; 343/872; 343/895

[58] Field of Search ..... 343/722, 713, 343/715, 872, 873, 895, 749, 900, 901

[56] References Cited

U.S. PATENT DOCUMENTS

| | | | |
|---|---|---|---|
| 4,160,979 | 7/1979 | Drewett | 343/788 |
| 4,163,981 | 8/1979 | Wilson | 343/715 |
| 4,375,642 | 3/1983 | Dörrie et al. | 343/895 |
| 4,376,941 | 3/1983 | Zenel | 343/709 |
| 4,379,298 | 4/1983 | Vincent et al. | 343/895 |
| 4,462,033 | 7/1984 | Grashow et al. | 343/715 |
| 4,567,487 | 1/1986 | Creaser, Jr. | 343/900 |
| 4,675,687 | 6/1987 | Elliott | 343/715 |
| 4,742,359 | 5/1988 | Ishino et al. | 343/895 |
| 4,920,354 | 4/1990 | Rauser et al. | 343/901 |
| 5,134,419 | 7/1992 | Egashira | 343/722 |
| 5,151,711 | 9/1992 | Taguchi | 343/715 |
| 5,341,149 | 8/1994 | Valimaa et al. | 343/895 |
| 5,359,340 | 10/1994 | Yokota | 343/792 |
| 5,402,135 | 3/1995 | DeMarre et al. | 343/715 |
| 5,451,967 | 9/1995 | Ueda et al. | 343/722 |
| 5,565,877 | 10/1996 | Du et al. | 343/715 |

FOREIGN PATENT DOCUMENTS

| | | |
|---|---|---|
| 3822664 A1 | 6/1976 | Germany . |
| 2358277 | 2/1989 | Germany . |

*Primary Examiner*—Donald T. Hajec
*Assistant Examiner*—Tan Ho
*Attorney, Agent, or Firm*—Lathrop & Clark

[57] ABSTRACT

A closed cell foam tubular muff encircles the helical coil portion of an automobile cellular phone antenna, the muff has a slanted top surface and reduces pressure differentials around the coil. The streamlined muff thereby reduces wind-induced whistling of the antenna. An alternative device is a solid cylindrical foam insert with a plurality of depressions formed therein which engages within the coil of the antenna. Both devices not only reduce the pressure effects which lead to whistling, but also, because of their foam composition, contribute to a damping of any randomly occurring vibrations.

17 Claims, 1 Drawing Sheet

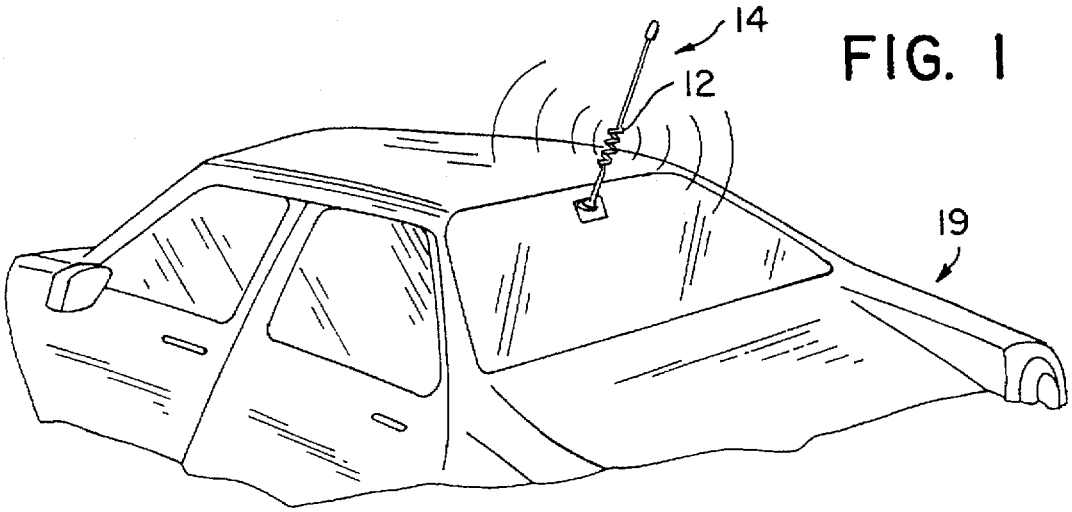
FIG. 1
FIG. 2
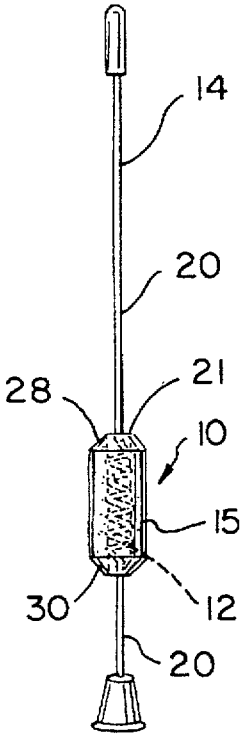
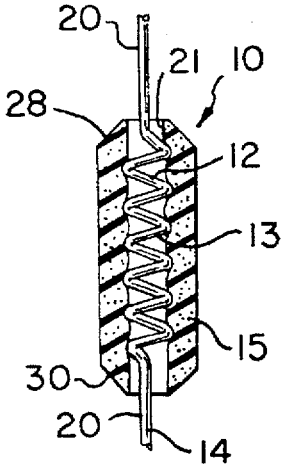
FIG. 3
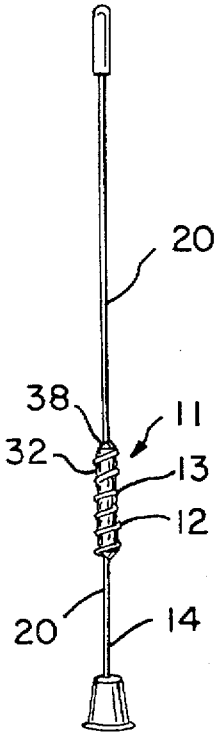
FIG. 4
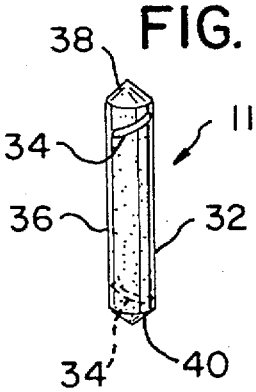
FIG. 5

AUTOMOTIVE MOBILE TELEPHONE ANTENNA SILENCER

FIELD OF THE INVENTION

The present invention relates to vehicular antennas in general, and to apparatus for reducing undesirable sounds generated by mobile telephone antennas in particular.

BACKGROUND OF THE INVENTION

Automotive designers have made significant progress in reducing the internal sound levels of automobile cabins. External wind noise from mirrors, windshield wipers and other protruding devices such as emblems and fins, has been reduced or eliminated by streamlining or removing the offending element. At the same time, cellular phones are an increasingly specified automotive accessory.

Antenna noise from AM/FM and Citizens Band radios has been attenuated by using streamlined cross-section antenna shafts, by applying variable pitch covers to the shafts, and by relocating the shafts to the rear of the vehicle. Due to the generally shorter length of cellular antennas, shaft vibration is not a primary concern. The typical cellular antenna does, however, have a central helical coil and wind across this coil can induce vibration and a whistling noise audible within the automobile cabin.

What is needed is a functional cellular phone antenna which may be mounted to an automobile and which does not produce an annoying whistling sound.

SUMMARY OF THE INVENTION

The cellular telephone antenna silencer of this invention is a closed-cell foam accessory for attachment to a conventional cellular antenna having a helical coil segment. The silencer reduces noise by first obstructing the open spaces in between the flights of the helical coil. This reduces the pressure differential, and presents a more streamlined shape to relative wind, thereby reducing the likelihood of small, localized pressure disturbances that create or induce vibration in the antenna. Secondly, the foam density and physical interference fit of the silencer serves to absorb randomly induced vibrations. In one embodiment, the silencer is a tubular closed cell, self skinning, UV-resistant flexible urethane hollow foam cover or muff which engages in a friction fit around the helical segment of the antenna. The muff has a low durometer and stiffness and is chamfered top and bottom, primarily to reduce drag and wind resistance. Another embodiment silencer, intended primarily for larger diameter coils measuring over 0.375 inches in diameter, is a closed cell, self skinning, UV-resistant, flexible solid urethane foam insert which is positioned within the flights of the helical segment of a cellular antenna. Tile insert silencer has a medium durometer and stiffness and has helical grooves on the outer surface that engage with the helix flights to lock and hold the insert in place. Both embodiments are constructed from a non-conductive, black or dark colored material that does not interfere with radio waves.

It is an object of the present invention to provide a device for reducing turbulent air flow around the helical coil of a cellular phone antenna.

It is a further object of the present invention to provide a device for damping vibrations of a cellular phone antenna.

It is an additional object of the present invention to provide a device which reduces undesired audible vibrations in a cellular phone antenna without disturbing signal transmission and reception.

Further objects, features and advantages of the invention will be apparent from the following detailed description when taken in conjunction with the accompanying drawings.

BRIEF DESCRIPTION OF THE DRAWINGS

FIG. 1 is an isometric view of an automotive cellular phone antenna positioned at the rear of an automobile where it is subject to wind-induced vibrations.

FIG. 2 is a side elevational view of the automotive cellular phone antenna silencer of this invention mounted to a cellular phone antenna.

FIG. 3 is an enlarged cross-sectional view of the silencer of FIG. 2.

FIG. 4 is a side elevational view of an alternative embodiment antenna silencer of this invention which is positioned within the coil of a cellular phone antenna.

FIG. 5 is an enlarged perspective view of the foam insert silencer of FIG. 4.

DESCRIPTION OF THE PREFERRED EMBODIMENTS

Referring more particularly to FIGS. 1–5, wherein like numbers refer to similar parts, a cellular phone antenna silencer 10 is shown in FIGS. 2–3. The silencer 10 is formed of closed cell, self-skinning foam, and is generally cylindrical. As shown in FIG. 1, a cellular telephone antenna 14 may be mounted to the rear window of an automobile 19. As the automobile moves along a road, the antenna 14 passes through the air to generate a relative wind flow across the antenna. In particular, the helical coil portion 12, comprised of a number of looped flights 13, is particularly prone to being vibrated by this relative wind velocity and thereby creating a whistling noise which can be disturbing to the occupants of the automobile.

The silencer 10 has a cylindrical body 15 with an axially extending bore 21 which passes through the body. The internal diameter of the bore 21 is less than the external diameter of the helical coil portion 12, for example about 80 percent of the diameter of the helical coil portion, so that the body 15 may be positioned over the helical coil portion and held in place with a friction fit. The thickness of the cylindrical wall of the body is preferably above 0.08 inches. In a preferred embodiment, the silencer 10 is formed of a UV-resistant, non-conductive foam material that is black or dark in color. Because the body foam is closed-cell, it will tend to shed rain and other moisture, rather than absorbing it. The foam is of a low durometer, low stiffness, to thereby facilitate mounting over the coil.

As shown in FIG. 3 the antenna 14 has two straight wire portions 20 which are connected by the helical coil portion 12. The length of the helical coil portion, defined as the distance between the two straight wire portions 20, may vary within a fairly narrow range. The length of the silencer body 15 is longer than the coil portion 12, for example about 110 percent of the length of the coil portion. The external diameter of the body 15 is approximately 125 percent of the external diameter of the helical coil portion 12. To eliminate sharp 90 degree intersections of surfaces on the silencer 10, the body 15 is chamfered so as to have an upper frustoconical surface 28 and a lower frustoconical surface 30. The inclination of the frustoconical surfaces is approximately 45 degrees with respect to the axis of the body 15.

The silencer 10 may be supplied as original equipment with a mobile automotive telephone antenna, or it may be supplied as a convenient accessory for retrofitting an antenna which is evidencing unpleasant whistling.

To install the silencer 10, the straight portion of the antenna is simply inserted through the central bore of the body, and the silencer is pressed down until the body engages with the helical coil portion of the antenna. The coil 12, being larger in diameter then the bore, causes a deformation of the body 15, resulting in a friction fit between the antenna coil and the silencer. The installed silencer 10 works in two ways to reduce noise. First, because the body 15 surrounds the coil, it substantially reduces wind which is blowing through the coil, and hence reduces the wind-induced vibration of the coil. Secondly, the resilient foam composition of the body 15 serves to a certain extent to damp out or absorb any randomly induced vibrations of the coil.

The muff type silencer 10 will find use primarily with the smaller diameter antenna coils, for example those which are 0.375 inches in diameter or less. For larger diameter coils an alternative embodiment insert type silencer 11, shown in FIGS. 4 and 5, may be employed.

The silencer 11 has a cylindrical foam body 32 with an external diameter which is approximately the same as the external diameter of the coil portion 12 of the antenna 14. Because of the resilient nature of the closed cell foam body 32, it will be compressed by the coil flights 13 when inserted into the coil. To lock the silencer 11 in place, it is preferably provided with grooves or slots 34 which are inclined to be aligned with the flights 13 of the coil portion 12. The slots 34 are recessed below the cylindrical surface 36 of the body 32 and at least one slot is formed on each side of the body. Multiple slots may be provided on each side. The body has a conical top surface 38 and a conical bottom surface 40 which serve to direct the relative wind around the coil portion 12. The angle of the conical surfaces is about 30 degrees with respect to a plane which is perpendicular to the axis of the cylindrical body 32. The height of the silencer 11 from the top surface 38 to the bottom surface 40 is preferably about 110 percent of the height of the coil portion. The insert silencer 11, although still resilient, is preferably formed of a medium durometer, medium stiffness foam, such that it will more positively lock into the helical coil portion.

It should be noted that the insert silencer may be formed with a hollow center to permit the insert to be more easily compressed and inserted within the helical coil of the antenna. In addition, although urethane foam has been disclosed as a material for the insert, other resilient foam materials may also be employed.

It is understood that the invention is not limited to the particular construction and arrangement of parts herein illustrated and described, but embraces such modified forms thereof as come within the scope of the following claims.

I claim:

1. A device for attachment to a mobile telephone antenna having a straight portion and a helical coil formed of a plurality of coil flights, the device comprising a cylindrical resilient foam body, wherein the foam body insertably engaged with the helical coil of the antenna and is deformed by the coil in a friction fit to fix the body to the helical coil and thereby block air flow through the coil.

2. The device of claim 1 further comprising portions of the body which define an axial bore, and wherein the helical coil is received within the axial bore.

3. The device of claim 2 wherein the helical coil of the antenna has a first external diameter, and wherein the axial bore has an inner diameter which is approximately 80 percent of the first external diameter.

4. The device of claim 2 wherein the helical coil of the antenna has a first length, and wherein the length of the body is approximately 110 percent of the first length.

5. The device of claim 1 further comprising portions of the body which define an outer cylindrical surface, and portions of the body define a plurality of grooves recessed below the outer cylindrical surface, each groove being positioned to engage with a flight of the helical coil, the body being disposed within the antenna helical coil.

6. The device of claim 5 wherein the helical coil of the antenna has a first external diameter, and wherein the outer cylindrical surface of the body has a diameter which is approximately equal to the first external diameter.

7. The device of claim 5 wherein the helical coil of the antenna has a first length, and wherein the length of the body is approximately 110 percent of the first length.

8. A device for attachment to a mobile telephone antenna having a straight portion and a helical coil formed of a plurality of coil flights, the device comprising a cylindrical resilient foam body, wherein the foam body engages with the helical coil of the antenna in a friction fit to fix the body to the helical coil and thereby block air flow through the coil, wherein portions of the body define an axial bore, and wherein the helical coil is received within the axial bore, and wherein portions of the body define a frustoconical top surface, and portions of the body define a frustoconical bottom surface, the top surface and the bottom surface serving to direct relative winds around the helical coil of the antenna.

9. A device for attachment to a mobile telephone antenna having a straight portion and a helical coil formed of a plurality of coil flights, the device comprising:

a cylindrical resilient foam body, wherein the foam body engages with the helical coil of the antenna in a friction fit to fix the body to the helical coil and thereby block air flow through the coil;

portions of the body which define an outer cylindrical surface; and portions of the body which define a plurality of grooves recessed below the outer cylindrical surface, each groove being positioned to engage with a flight of the helical coil, the body being disposed within the antenna helical coil; wherein portions of the body define a conical top surface, and portions of the body define a conical bottom surface below the top surface, the top surface and the bottom surface serving to direct relative winds around the helical coil of the antenna.

10. The device of claim 9 wherein the inclination of the conical surfaces is approximately 30 degrees.

11. A mobile telephone antenna assembly comprising:

a) a mobile telephone antenna having a straight portion and a helical coil formed of a plurality of coil flights, the coil having a first diameter; and b) a cylindrical resilient foam body, wherein the foam body has portions defining an interior bore which has a diameter which is less than the first diameter of the antenna coil, the foam body being insertably engaged with the helical coil of the antenna in a friction fit to deform the body and thereby fix the body to the helical coil and thereby block air flow through the coil.

12. The assembly of claim 11 wherein the helical coil of the antenna has a first external diameter, and wherein the axial bore has an inner diameter which is approximately 80 percent of the first external diameter.

13. The assembly of claim 11 wherein the helical coil of the antenna has a first length, and wherein the length of the body is approximately 110 percent of the first length.

14. The assembly of claim 11 further comprising portions of the body which define an outer cylindrical surface, and portions of the body define a plurality of grooves recessed below the outer cylindrical surface, and the body is disposed within the antenna helical coil such that each groove engages with a flight of the helical coil.

15. A mobile telephone antenna assembly comprising:

a) a mobile telephone antenna having a straight portion and a helical coil formed of a plurality of coil flights;

b) cylindrical resilient foam body which is engaged with the helical coil of the antenna in a friction fit to fix the body to the helical coil and thereby block air flow through the coil, wherein portions of the body define an axial bore, and wherein the helical coil extends through the axial bore;

c) portions of the body which define a frustoconical top surface, and d) portions of the body defining a frustoconical bottom surface, the inclinations of the frustoconical surfaces being about 45 degrees, and the top surface and the bottom surface serving to direct relative winds around the helical coil of the antenna.

16. A mobile telephone antenna assembly comprising:

a) mobile telephone antenna having a straight portion and a helical coil formed of a plurality of coil flights;

b) a cylindrical resilient foam body which is engaged with the helical coil of the antenna in a friction fit to fix the body to the helical coil and thereby block air flow through the coil;

c) portions of the body which define an outer cylindrical surface;

d) portions of the body which define a plurality of grooves recessed below the outer cylindrical surface, wherein the body is disposed within the antenna helical coil such that each groove engages with a flight of the helical coil; and e) wherein portions of the body define a conical top surface, and portions of the body define a conical bottom surface below the top surface, the top surface and the bottom surface serving to direct relative winds around the helical coil of the antenna.

17. A device for attachment to a mobile telephone antenna having a straight portion and a helical coil formed of a plurality of coil flights the device serving as an accessory for retrofitting an antenna which is evidencing unpleasant whistling, the device comprising:

a) a cylindrical body formed of a resilient closed cell foam material, being insertable within the helical coil flights; and b) portions of the body which define a cylindrical outer surface, wherein the helical coil has a first internal diameter, and the cylindrical outer surface has an external diameter which is greater than the first internal diameter; and c) portions of the body which define a plurality of grooves which are recessed below the cylindrical outer surface, the grooves being positioned to engage with individual coil flights when the body is deformed to pass within the helical coil and is disposed in a friction fit within the helical coil of the antenna, the body thereby blocking air flow through the coil.

* * * * *